US008763572B1

(12) United States Patent
Dike

(10) Patent No.: US 8,763,572 B1
(45) Date of Patent: Jul. 1, 2014

(54) MECHANICAL VARIABLE TIMING DEVICE THAT ADJUSTS THE PIVOT POINT AT WHICH A ROCKER ARM PIVOTS

(71) Applicant: Anthony Dike, Ben Wheeler, TX (US)

(72) Inventor: Anthony Dike, Ben Wheeler, TX (US)

( * ) Notice: Subject to any disclaimer, the term of this patent is extended or adjusted under 35 U.S.C. 154(b) by 0 days.

(21) Appl. No.: 13/710,666

(22) Filed: Dec. 11, 2012

(51) Int. Cl.
*F01L 1/34* (2006.01)

(52) U.S. Cl.
USPC ..... 123/90.16; 123/90.39; 123/90.41

(58) Field of Classification Search
CPC ..... F01L 13/0036; F01L 1/18; F01L 1/181; F01L 1/182; F01L 1/146; F01L 13/0026; F01L 13/0021; F01L 13/0031; F01L 13/0063; F01L 2001/188; F01L 13/00; F01L 1/20; F01L 13/0015
See application file for complete search history.

(56) References Cited

U.S. PATENT DOCUMENTS 3,413,965 A * 12/1968 Gavasso ..... 123/90.16
4,438,736 A 3/1984 Hara et al.
4,483,283 A * 11/1984 Hausknecht ..... 123/90.46
4,484,546 A 11/1984 Burandt
4,502,426 A 3/1985 Skelley
4,526,142 A 7/1985 Hara et al.
4,638,773 A * 1/1987 Bonvallet ..... 123/90.16
4,724,822 A 2/1988 Bonvallet
4,841,799 A * 6/1989 Entzminger ..... 74/522
5,107,803 A 4/1992 Furnivall
6,412,461 B2 * 7/2002 Nakashima ..... 123/90.16
6,491,008 B1 12/2002 Zubeck
7,066,123 B2 * 6/2006 Richardson ..... 123/90.41
7,546,823 B2 * 6/2009 Buelna ..... 123/90.16
7,913,656 B2 3/2011 Magnan et al.

* cited by examiner

*Primary Examiner* — Thomas Denion
*Assistant Examiner* — Daniel Bernstein
(74) *Attorney, Agent, or Firm* — Kyle A. Fletcher, Esq.

(57) ABSTRACT

The mechanically operable variable timing device for use with a rocker arm pivot point that is able to adjust the valve timing and lift on a valve stem by adjusting the pivot point of the rocker arm. The mechanically operated variable timing device includes a cam that rotates independent of engine RPM in order to adjust the pivot point of the rocker arm, which in turn adjusts the lift and valve timing of the engine at any RPM. The mechanically operated variable timing device places the cam above a plunger, which is positioned over the respective rocker arm. The plunger is biased upwardly via a spring positioned between the ball fulcrum of the rocker arm and a bottom portion of the plunger. A pivot shaft is threadably engaged to a threaded hole located on a top surface of the engine block.

16 Claims, 5 Drawing Sheets

MECHANICAL VARIABLE TIMING DEVICE THAT ADJUSTS THE PIVOT POINT AT WHICH A ROCKER ARM PIVOTS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of internal combustion engines, more specifically, the rocker arm pivot point.

Internal combustion engines are constantly evolving. Internal combustion engines are always being modified to improve performance or to improve efficiency. This is more important with the ever-increasing cost of gasoline and diesel fuels. One component of a gasoline engine that is in want of increased variability is the rocker arm of the valve timing of the internal combustion engine. There have been many attempts over the years to provide for variability in the timing of the internal combustion engine and/or to variably adjust the lift of the valve stem.

The device of the present application seeks to address this need by providing a purely mechanical means with which to adjust the timing as well as the lift of the rocker arm.

B. Discussion of the Prior Art

As a preliminary note, it should be stated that there is an ample amount of prior art that deals with variable lift and timing systems, generally speaking. However, no prior art discloses a mechanically operated variable timing device that works to adjust the location of a pivot point, for a rocker arm such that the pivot point may be adjusted along a vertical axis, and which is adjusted independent of RPM of the respective engine, and which is able to adjust the valve timing and lift to optimize timing and lift at different RPMs; wherein the mechanically operated variable timing device includes a cam that is able to rotate independent of engine RPM, and which engages a plunger positioned over the respective rocker arm; wherein the plunger is biased upwardly via a spring positioned between the ball fulcrum of the rocker arm and a bottom portion of the plunger; wherein a pivot shaft is threadably engaged to a threaded hole located on a top surface of the engine block; wherein the pivot shaft extends vertically through the rocker arm and ball fulcrum; wherein the pivot shaft extends into a bottom cavity located in the plunger in order to support the various componentry associated with the mechanically operated variable timing device.

The Bonvallet Patent (U.S. Pat. No. 4,724,822) discloses a variable valve lift and timing valve train mechanism that includes a rocker arm, valve actuator, and reaction member. However, the mechanism employs the use of a hydraulic lash adjuster in conjunction with the reaction member and a spring to adjust the pivot point of the rocker arm. Moreover, the mechanism is a purely mechanically operated device that is linearly aligned along a vertical axis in order to raise and lower the pivot point.

The Zubeck Patent (U.S. Pat. No. 6,491,008) discloses a variable valve timing adjustable roller rocker arm assembly that includes an adjustment cam operates to move a cam roller along the rocker arm. Though the linkage and cam roller are purely mechanical in operation, they do not use a configuration that adjust the pivot point along a vertical axis via a limiter, secondary spring, and ball fulcrum that push downwardly to limit the location of the pivot point of the rocker arm.

The Skelley Patent (U.S. Pat. No. 4,502,426) discloses a variable valve lift and timing mechanism that uses a hydraulic cylinder moving an actuating piston that is mechanically linked to the pivot shaft for controlling the same. Again, not a purely mechanical system that adjusts the pivot point along a vertical axis via an adjustable limiter stop, secondary spring, and ball fulcrum.

The Magnan et al. Patent (U.S. Pat. No. 7,913,656) discloses a variable displacement engine having selectively engageable rocker arm with positioning device. Again the selectively engageable rocker arm with positioning device is not a limiting cam that rotates to adjust the pivot point of the rocker arm along a vertical axis, and independent of engine RPM.

The Wride Patent (U.S. Pat. No. 4,901,684) discloses a variable lift cam follower that can vary the timing and lift of a valve upon rotation of the support. Again, the mechanism is not a purely mechanical device that adjusts the timing and lift via changing the pivot point of the rocker arm along a vertical axis.

The Furnivall Patent (U.S. Pat. No. 5,107,803) discloses a split-action rocker arm that is mountable on an engine rocker shaft for transmitting the rotational motion of a cam on a camshaft into the linear motion of a valve lifter. Again, the split-action rocker arm is not a purely mechanical system that adjusts the pivot point of a rocker arm along a vertical axis in order to adjust lift and timing of the respective valve(s).

The Hara et al. Patent (U.S. Pat. No. 4,526,142) discloses a variable valve timing arrangement for an internal combustion engine or the like. Again, the arrangement does not involve adjustment of the pivot point of the rocker arm along a vertical axis.

The Burandt Patent (U.S. Pat. No. 4,484,546) discloses a variable valve operating mechanism for an internal combustion engine. Again, the mechanism adjusts an upper rocker arm along a distal end that is actuated via a servo mechanism.

The Hara et al. Patent (U.S. Pat. No. 4,438,736) discloses a variable valve timing arrangement with automatic valve clearance adjustment. However, the arrangement is not able to adjust the pivot point of the rocker arm along a vertical axis.

While the above-described devices fulfill their respective and particular objects and requirements, they do not describe a mechanically operated variable timing device that works to adjust the location of a pivot point for a rocket arm such that the pivot point may be adjusted along a vertical axis, and which is adjusted independent of RPM of the respective engine, and which is able to adjust the valve timing and lift to optimize timing and lift at different RPMs; wherein the mechanically operated variable timing device includes a cam that is able to rotate independent of engine RPM, and which engages a plunger positioned over the respective rocker arm; wherein the plunger is biased upwardly via a spring positioned between the ball fulcrum of the rocker arm and a bottom portion of the plunger; wherein a pivot shaft is threadably engaged to a threaded hole located on a top surface of the engine block; wherein the pivot shaft extends vertically through the rocker arm and ball fulcrum; wherein the pivot shaft extends into a bottom cavity located in the plunger in order to support the various componentry associated with the mechanically operated variable timing device. In this regard, the mechanically operable variable timing device for use with a rocker arm pivot point departs from the conventional concepts and designs of the prior art.

SUMMARY OF THE INVENTION

The mechanically operable variable timing device for use with a rocker arm pivot point that is able to adjust the valve timing and lift on a valve stem by adjusting the pivot point of the rocker arm. The mechanically operated variable timing device includes a cam that rotates independent of engine RPM in order to adjust the pivot point of the rocker arm, which in turn adjusts the lift and valve timing of the engine at any RPM. The mechanically operated variable timing device places the cam above a plunger, which is positioned over the respective rocker arm. The plunger is biased upwardly via a spring positioned between the ball fulcrum of the rocker arm and a bottom portion of the plunger. A pivot shaft is threadably engaged to a threaded hole located on a top surface of the engine block, and extends vertically through the rocker arm and ball fulcrum. The pivot shaft extends into a bottom cavity located in the plunger in order to support the various componentry associated with the mechanically operated variable timing device.

An object of the invention is to provide a mechanically operated variable timing device for use with a rocker arm of an internal combustion engine, which operates independent of the internal combustion engine and also varies the timing and lift of the applicable valve stem.

A further object of the invention is to provide a variable timing device that utilizes few components to vary timing and lift of a valve stem by adjusting the pivot point of the rocker arm.

A further object of the invention is to provide a purely mechanical variable timing device that solely requires rotation of a cam in order to adjust the pivot point of the rocker arm, which in turn adjusts the timing and lift of the valve stem.

An even further object of the invention is to provide a plunger that is biased upwardly and away from the ball fulcrum and rocket arm, and which further engages against the cam to adjust the pivot point.

An even further object of the invention is to provide a spring and pivot shaft that align and bias the plunger against the cam.

These together with additional objects, features and advantages of the mechanically operable variable timing device for use with a rocker arm pivot point will be readily apparent to those of ordinary skill in the art upon reading the following detailed description of presently preferred, but nonetheless illustrative embodiments of the mechanically operable variable timing device for use with a rocker arm pivot point when taken in conjunction with the accompanying drawings.

In this respect, before explaining the current embodiments of the mechanically operable variable timing device for use with a rocker arm pivot point in detail, it is to be understood that the mechanically operable variable timing device for use with a rocker arm pivot point is not limited in its applications to the details of construction and arrangements of the components set forth in the following description or illustration.

Those skilled in the art will appreciate that the concept of this disclosure may be readily utilized as a basis for the design of other structures, methods, and systems for carrying out the several purposes of the mechanically operable variable timing device for use with a rocker arm pivot point.

It is therefore important that the claims be regarded as including such equivalent construction insofar as they do not depart from the spirit and scope of the mechanically operable variable timing device for use with a rocker arm pivot point. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations.

All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
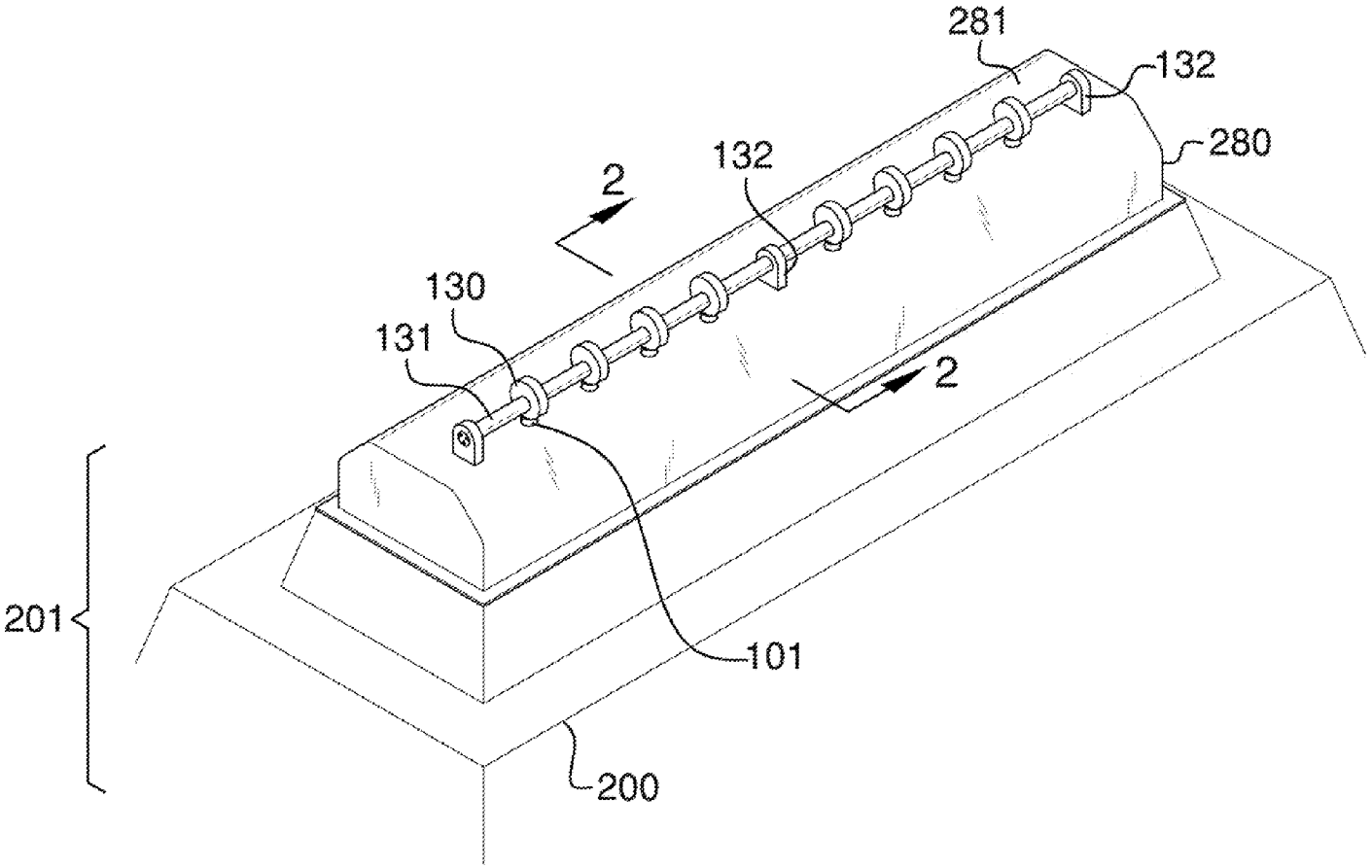
FIG. 1 illustrates an outer, perspective view of an internal combustion engine whereby the mechanically operable variable timing device is installed thereon.
Figure 2A:
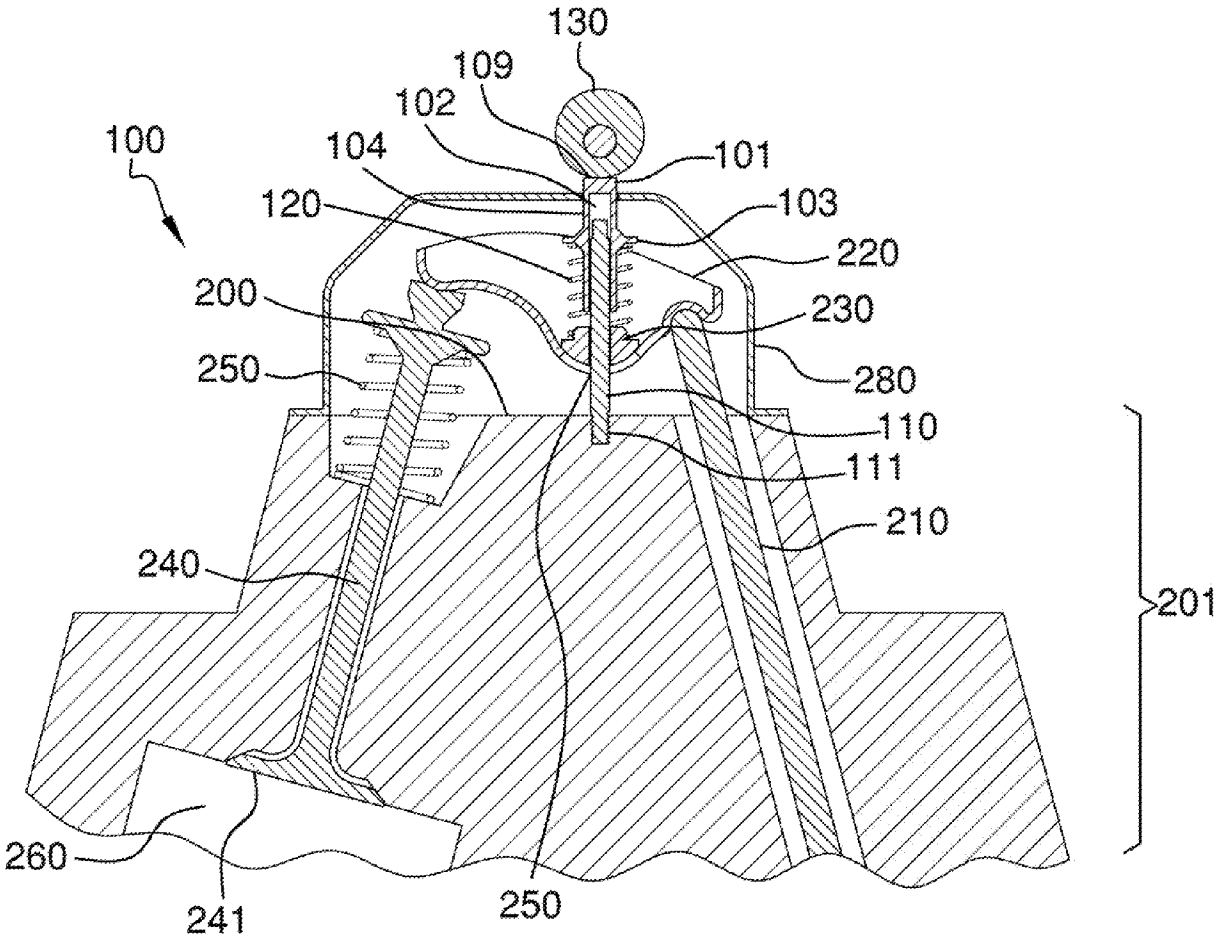
FIG. 2A illustrates a cross-sectional view along line 2-2 in FIG. 1, and depicting the arrangement of the cam, plunger, spring, pivot shaft with respect to the ball fulcrum and rocker arm, and further detailing the cam in an up position with the valve closed.
Figure 2B:
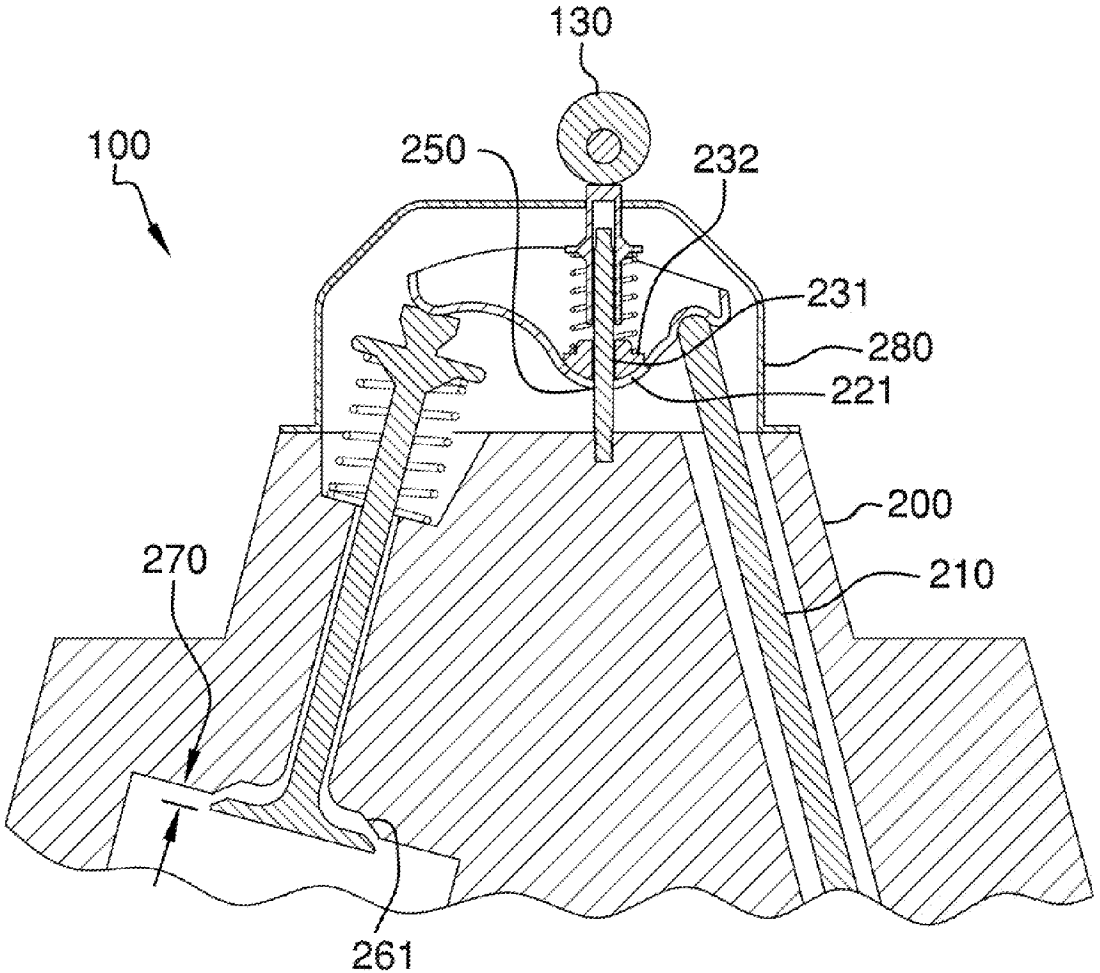
FIG. 2B illustrates a illustrates a cross-sectional view along line 2-2 in FIG. 1, and further detailing the cam in an up position with valve opened.
Figure 2C:
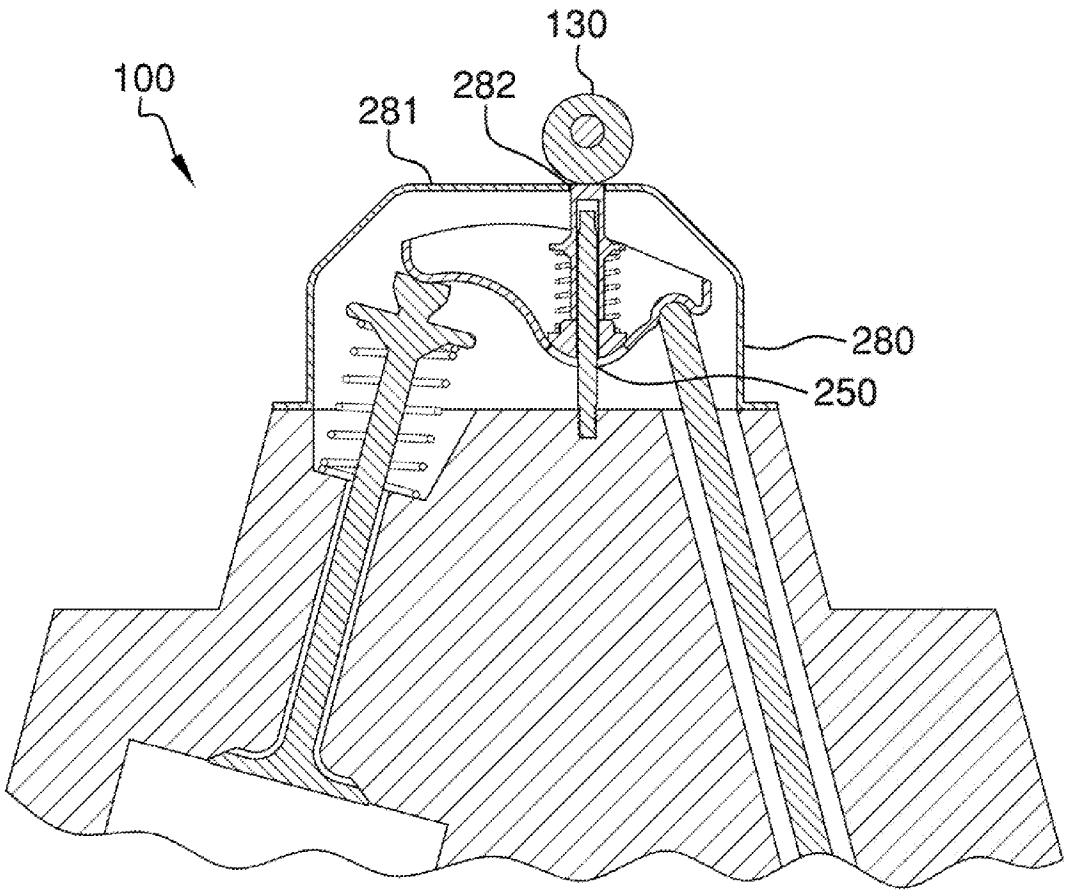
FIG. 2C illustrates a illustrates a cross-sectional view along lane 2-2 in FIG. 1, and further detailing the came in a down position with the valve closed.
Figure 2D:
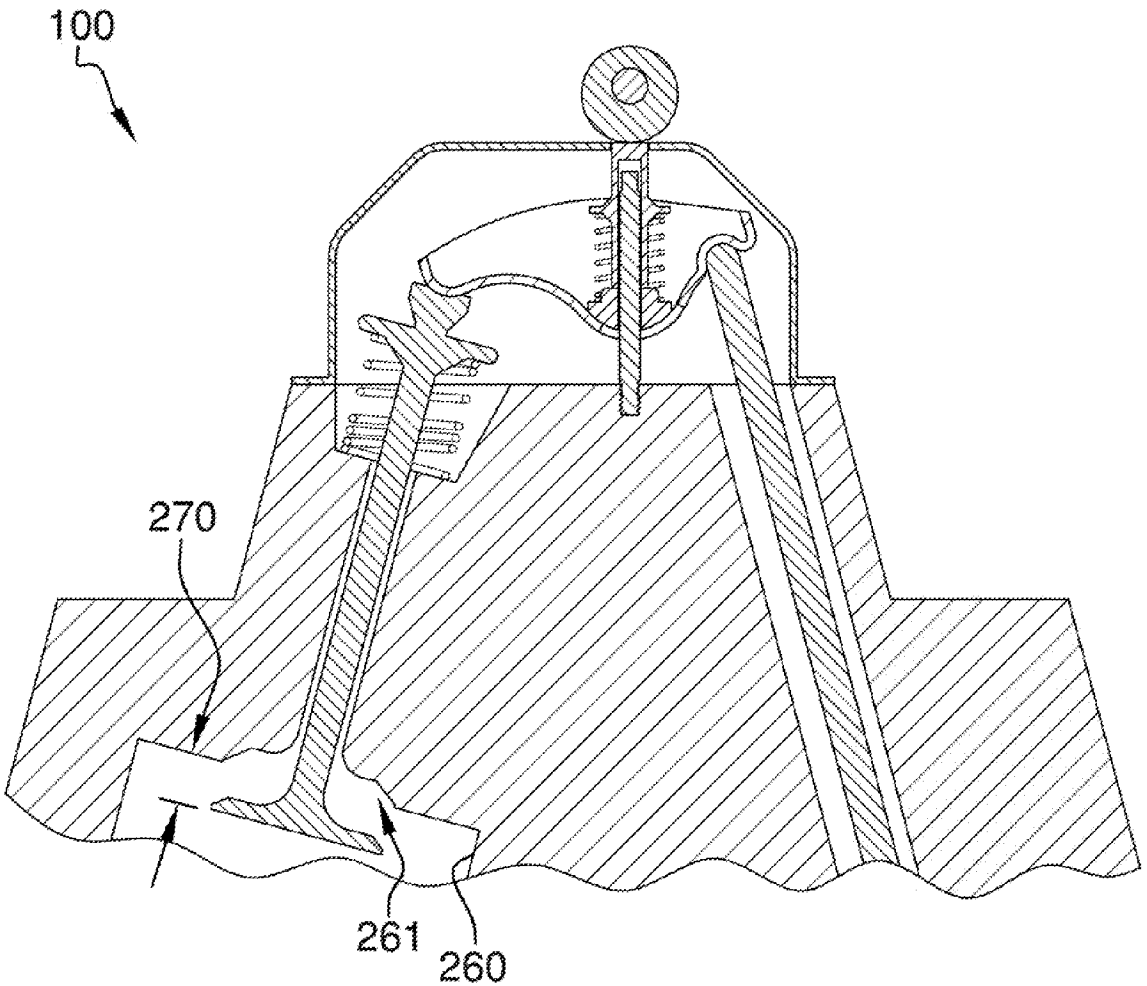
FIG. 2D illustrates a cross-sectional view along line 2-2 in FIG. 1 and further detailing the cam in a down position with the vale opened.

Detailed reference will now be made to the preferred embodiment of the present invention, examples of which are illustrated in FIGS. 1-2D. A mechanically operable variable timing device for use with a rocker arm pivot point 100 (hereinafter invention) includes a plunger 101 that is further defined with a cavity 102 that is accessed from underneath. The plunger 102 includes a shoulder 103 that extends radially from an exterior surface 104.

The invention 100 includes a pivot shaft 110, a spring 120, and a cam 130. The pivot shaft 110 is a rod of an undefined diameter and length. The pivot shaft 110 includes a threaded end 111 that is secured to an engine block 200. The pivot shaft 110 extends vertically therefrom, and engages into the cavity 102 of the plunger 101 such that the plunger 101 is able to travel up and down with respect to the pivot shaft 110 and the engine block 200. The engine block 200 includes parts commonly associated with an internal combustion engine 201, which comprises a push up rod 210, a rocker arm 220, a ball fulcrum 230, a valve stem 240, and a valve spring 250. The push up rod 210, the rocker arm 220, the ball fulcrum 230, the valve stem 240, and the valve spring 250 are well known in the art, and are used in connection with the invention 100 in order to adjust valve timing and lift.

The pivot shaft 110 of the invention 100 passes through a rocker arm hole 221 of the rocker arm 220 as well as a fulcrum hole 231 of the ball fulcrum 230. The pivot shaft 110 is important to the invention 100 in that the pivot shaft 110 aligns the plunger 101 above the ball fulcrum 230 and the rocker arm 220. Moreover, the ball fulcrum 230 and the rocker arm 220 are able to rotate in a traditional sense with the internal combustion engine. However, the rocker pivot point 250 is able to be adjusted entirely as a result of the invention 100. The rocker pivot point 250 shall be define as the point at which the rocker arm 220 rotates back and forth with respect to the push up rod 210 and the valve stem 240.

It shall be noted that the invention 100 includes and places the spring 120 between a top fulcrum surface 232 of the ball fulcrum 230 and the shoulder 103 of the plunger 101. The spring 120 is important to the overall functionality of the invention 100 in that the spring 120 imposes a biasing force that pushes the plunger 101 upwardly with respect to the ball fulcrum 230. Moreover, the spring 120 pushes the plunger 101 upwardly towards the cam 130 such that the cam 130 is always in contact with a top plunger surface 109.

The cam 130 of the invention 100 is able to rotate independent of the RPMs of the internal combustion engine 201. Moreover, the cam 130 adjusts the elevation of the plunger 101 with respect to the engine block 200. As the elevation of the plunger 101 is adjusted, the rocker pivot point 251 changes as well, which in turn adjusts the timing (time at which the valve stem 240 opens or closes with respect to a cylinder 260) as well as the lift 270 (length of opening between a valve 241 and cylinder opening 261. Referring to FIGS. 2B and 2D), there are a couple of things to note: (1) the rocker pivot point 250 changes, and (2) the size of the lift 270 changes.

The invention 100 is a purely mechanical approach that uses a linearly-aligned set of components in order to adjust the rocker pivot point 250, which in turn adjusts valve timing and lift. The cam 130 includes a camshaft 131 that spans across all applicable valves and cylinders of the internal combustion engine 201. Moreover, the camshaft 131 is supported by cam supports 132 that may be located on an external surface 281 of a cylinder head 280. Therefore, the cylinder head 280 requires holes 282 to be formed into the external surface 281 in order for the top plunger surface 109 of the plunger 101 to engage the cam 130 that rotates thereon. The camshaft 131 is rotated via an auxiliary drive source, which may be in the form of an electric motor or other component that is able to operate independent of the RPMs of the internal combustion engine 201.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A mechanically operable variable timing device for use with a rocker arm pivot point comprising:

a plunger engaged upwardly against a cam that is adaptively rotated independent of an existing internal combustion engine;

wherein a pivot shaft and spring align and orient the plunger between a ball fulcrum and the cam, and thereby enable adjustment of a rocker pivot point, which in turn adjusts the timing and lift of a valve stem with respect to a cylinder of said internal combustion engine.

2. The mechanically operable variable timing device as described in claim 1 wherein the plunger is further defined with a cavity that is accessed from underneath; wherein the plunger includes a shoulder that extends radially from an exterior surface.

3. The mechanically operable variable timing device as described in claim 2 wherein the pivot shaft is a rod; wherein the pivot shaft includes a threaded end that is secured to an engine block.

4. The mechanically operable variable timing device as described in claim 3 wherein the pivot shaft extends vertically with respect to the engine block, and engages into the cavity of the plunger such that the plunger is able to travel up and down with respect to the pivot shaft and the engine block.

5. The mechanically operable variable timing device as described in claim 4 wherein the pivot shaft passes through a rocker arm hole of the rocker arm as well as a fulcrum hole of the ball fulcrum; wherein the rocker pivot point is the point at which the rocker arm rotates back and forth with respect to a push up rod and the valve stem.

6. The mechanically operable variable timing device as described in claim 5 wherein the spring is positioned between a top fulcrum surface of the ball fulcrum and the shoulder of the plunger; wherein the spring biases the plunger upwardly in order to engage against the cam.

7. The mechanically operable variable timing device as described in claim 6 wherein the cam adjusts the elevation of the plunger with respect to the engine block; wherein elevation of the plunger is adjusted, which in turn adjusts the rocker pivot point as well, and which also adjusts the timing as well as the lift.

8. The mechanically operable variable timing device as described in claim 7 wherein the cam includes a camshaft that spans across at least one valve and cylinder of the internal combustion engine.

9. The mechanically operable variable timing device as described in claim 8 wherein the camshaft is supported by at least one cam support that is located on an external surface of a cylinder head of said internal combustion engine; wherein the cylinder head includes a hole in the external surface in order for a top plunger surface of the plunger to engage the cam that rotates thereon.

10. A mechanically operable variable timing device for use with a rocker arm pivot point comprising:

a plunger engaged upwardly against a cam that is adaptively rotated independent of an existing internal combustion engine;

wherein a pivot shaft and spring align and orient the plunger between a ball fulcrum and the cam, and thereby enable adjustment of a rocker pivot point, which in turn adjusts the timing and lift of a valve stem with respect to a cylinder of said internal combustion engine;

wherein the plunger is further defined with a cavity that is accessed from underneath; wherein the plunger includes a shoulder that extends radially from an exterior surface;

wherein the pivot shaft is a rod;

wherein the pivot shaft includes a threaded end that is secured to an engine block.

11. The mechanically operable variable timing device as described in claim 10 wherein the pivot shaft extends vertically with respect to the engine block, and engages into the cavity of the plunger such that the plunger is able to travel up and down with respect to the pivot shaft and the engine block.

12. The mechanically operable variable timing device as described in claim 11 wherein the pivot shaft passes through a rocker arm hole of the rocker arm as well as a fulcrum hole of the ball fulcrum; wherein the rocker pivot point is the point at which the rocker arm rotates back and forth with respect to a push up rod and the valve stem.

13. The mechanically operable variable timing device as described in claim 12 wherein the spring is positioned between a top fulcrum surface of the ball fulcrum and the shoulder of the plunger; wherein the spring biases the plunger upwardly in order to engage against the cam.

14. The mechanically operable variable timing device as described in claim 13 wherein the cam adjusts the elevation of the plunger with respect to the engine block; wherein elevation of the plunger is adjusted, which in turn adjusts the rocker pivot point as well, and which also adjusts the timing as well as the lift.

15. The mechanically operable variable timing device as described in claim 14 wherein the cam includes a camshaft that spans across at least one valve and cylinder of the internal combustion engine.

16. The mechanically operable variable timing device as described in claim 15 wherein the camshaft is supported by at least one cam support that is located on an external surface of a cylinder head of said internal combustion engine; wherein the cylinder head includes a hole in the external surface in order for a top plunger surface of the plunger to engage the cam that rotates thereon.

* * * * *